US009181953B2

(12) United States Patent
Steger et al.

(10) Patent No.: US 9,181,953 B2
(45) Date of Patent: Nov. 10, 2015

(54) CONTROLLING PUMPS FOR IMPROVED ENERGY EFFICIENCY

(75) Inventors: Perry C. Steger, Georgetown, TX (US); David Mark Pierce, Austin, TX (US)

(73) Assignee: SPECIFIC ENERGY, Georgetown, TX (US)

( * ) Notice: Subject to any disclaimer, the term of this patent is extended or adjusted under 35 U.S.C. 154(b) by 1506 days.

(21) Appl. No.: 12/571,895

(22) Filed: Oct. 1, 2009

(65) Prior Publication Data

US 2011/0081255 A1 Apr. 7, 2011

(51) Int. Cl.
*F04D 15/00* (2006.01)

(52) U.S. Cl.
CPC ..... *F04D 15/0066* (2013.01)

(58) Field of Classification Search
USPC ..... 417/43, 44.11, 45, 426; 702/50, 100; 700/282
See application file for complete search history.

(56) References Cited

U.S. PATENT DOCUMENTS

| | | | | |
|---|---|---|---|---|
| 2,804,021 | A * | 8/1957 | Swearingen | 417/407 |
| 4,204,808 | A * | 5/1980 | Reese et al. | 417/2 |
| 4,330,237 | A | 5/1982 | Battah | |
| 4,486,148 | A | 12/1984 | Battah | |
| 4,835,687 | A | 5/1989 | Martin | |
| 5,742,500 | A * | 4/1998 | Irvin | 700/9 |
| 6,045,331 | A * | 4/2000 | Gehm et al. | 417/2 |
| 7,143,016 | B1 * | 11/2006 | Discenzo et al. | 703/3 |
| 7,797,062 | B2 * | 9/2010 | Discenzo et al. | 700/28 |
| 2007/0154321 | A1 * | 7/2007 | Stiles et al. | 417/44.1 |
| 2010/0312400 | A1 * | 12/2010 | Steffensen | 700/282 |

OTHER PUBLICATIONS

Simon Bunn; "Closing the Loop in Water Supply Optimisation"; The IET Water Event; 2007; 10 pages.
S. Bunn; "Operating Pumps to Maximise Efficiency"; Pumping and Pipelines; Jun. 2009; pp. 28-33.
Michael Volk; "Pump Characteristics and Applications, 2nd Edition"; 2005; pp. 372-381.
Garr M. Jones; "Pumping Station Design, Revised 3rd Edition"; 2008; 3 pages.
"Variable Speed Pumping, A Guide to Successful Applications"; Europump and Hydraulic Institute; 2004; 8 pages.
A.E. Stavale, J.A. Lorenc, and E.P. Sabini; "Development of a Smart Pumping System"; 2001; 22 pages.

* cited by examiner

*Primary Examiner* — Devon Kramer
(74) *Attorney, Agent, or Firm* — Meyertons Hood Kivlin Kowert & Goetzel, P.C.; Jeffrey C. Hood

(57) ABSTRACT

A method for improving the energy efficiency of a pump system. The method includes measuring an instantaneous power consumption of the pump system, measuring an instantaneous fluid flow rate of the pump system, and determining an instantaneous specific energy consumption (SEC) of the pump system based on the instantaneous power consumption and the instantaneous fluid flow rate. The method then adjusts the speed of a pump in response to the determined SEC. The above steps may be performed a number of times to seek a reduced value of the instantaneous SEC of the pump system.

28 Claims, 7 Drawing Sheets

CONTROLLING PUMPS FOR IMPROVED ENERGY EFFICIENCY

FIELD OF THE INVENTION

This invention relates to a system and method of controlling pumps for the improvement of energy efficiency.

DESCRIPTION OF THE RELATED ART

According to a study commissioned by the US Department of Energy, pumping systems account for nearly 20% of the world's electrical energy demand and range from 25-50% of the energy usage in certain industrial plant operations. Electrical motor driven pumps may be used for water wells, water treatment plant raw water pumps, transfer pump stations, wastewater lift stations and a large variety of industrial applications that move fluids. Many of today's pumps are centrifugal pumps driven by AC induction motors. Typically, these induction motors operate at a fixed speed, based on the frequency of the AC power source. In the United States, 60 Hz power drives common synchronous AC induction motor speeds of 3600, 1800, 1200, and 900 rpm (rotations per minute). Variable frequency drives (VFDs) are becoming commonplace, and these VFDs may be used to convert fixed speed motors to variable speed motors by converting the incoming power (e.g., 60 Hz power) to adjustable frequency power, thus converting the motor/pump assembly from fixed speed pump to finely controllable variable speed. VFDs are examples of adjustable speed drives (ASDs). Other examples of ASDs are direct engine drives, combination engine/motor drives, magnetic eddy-current coupling drives, fluid coupling (hydrokinetic) drives, variable transmissions (including variable-ratio belt drives), and hydrostatic drives.

Centrifugal pumps have characteristic pump curves that describe the relationships between flow rate and head (or pressure) at a given pump speed. As pressure increases, flow rate typically decreases, in a curved, nonlinear fashion. Pumps generally operate as a part of an overall pump system that may include a network of pipes, tanks, valves and varying flow rate demands. This overall system may be characterized with a specific known set of operating conditions (e.g., tank levels, valve position, fluid demands, etc.) as a system curve, which describes flow rate versus pressure. A typical system curve may show that, unlike a pump curve, as flow rate increases, pressure also increases. The intersection of the pump curve and the system curve for a specific set of conditions is known as the operating point, and this point may indicate the flow rate and pump head for this particular set of conditions at the given location. The operating point may be adjusted by changing the speed of a pump: increase the pump speed and flow rate and pressure increase; decrease pump speed and flow and pressure decrease, following the system curve. Pumps that respond to varying system demands (e.g., to attempt to maintain levels in elevated water tanks by transferring water from lower tanks) may rarely operate at or near peak energy efficiency. This may be because these pumps, even when equipped with VFDs, typically operate at a fixed speed.

Accordingly it is desirable to provide a system and method for the control of variable speed pump systems (e.g., ASD centrifugal pump systems) to provide continual energy efficient operation.

SUMMARY OF THE INVENTION

Embodiments of the invention relate to controlling a pump system for improved energy efficiency. The pump system may comprise one or more pumps. The method may include measuring instantaneous power consumption of the pump system, measuring instantaneous fluid flow rate of the pump system, and determining instantaneous specific energy consumption (SEC) of the pump system based on the instantaneous power consumption and the instantaneous fluid flow rate. The method may then adjust the speed of at least one pump in response to the determined instantaneous SEC of the pump system. The method may perform the above steps multiple times to seek a reduced value of the instantaneous SEC of the pump system. Thus the method may repeatedly perform the following steps to seek a reduced value of the instantaneous SEC of the pump system: measure instantaneous power consumption, measure instantaneous fluid flow rate, determine an instantaneous SEC of the pump system, and adjust the speed of at least one pump based on the determined instantaneous SEC of the pump system.

In some embodiments, the speed of the pump may be adjusted according to a change direction, e.g., either by increasing or decreasing the speed of the pump. Additionally, the method may further determine whether the current instantaneous SEC is greater than a previous instantaneous SEC. The change direction may be set to the opposite direction if the current instantaneous SEC is greater than the previous SEC. For example, the method may increase the rotational speed of the pump if the change direction is set to increasing or decrease the rotational speed of the pump if the change direction is set to decreasing. In some embodiments where the speed of the pump is controlled by an adjustable speed drive (ASD), adjusting the speed of the pump may include adjusting a speed associated with the adjustable speed drive.

In some embodiments, the method may adjust the speed of the pump to fall only between a low speed threshold and a high speed threshold (referred to as clamping the speed of the pump). The method may also increase the size of the speed adjustment relative to a previous speed adjustment size if the instantaneous SEC is determined to be not greater than a previous instantaneous SEC. Correspondingly, the method may decrease the size of the speed adjustment relative to the previous speed adjustment size if the instantaneous SEC is determined to be greater than the previous instantaneous SEC.

In some embodiments, the method may be performed without any prior knowledge of a pump curve associated with the pump, of a pump efficiency curve associated with the pump, and/or of a system curve associated with the pump system.

Provided also is a pump system according to one or more embodiments. The pump system may include a pump control unit, a power meter that may be coupled to the pump control unit, a flow meter that may be coupled to the pump control unit and a group of one or more pumps that may also be coupled to the pump control unit. The flow meter may be configured to measure instantaneous flow rate of the pump system and the power meter may be configured to measure instantaneous power consumption of the pump system. The pump control unit may be configured to perform the steps described above. For example, the pump control unit may be configured to: obtain a measurement of the instantaneous power consumption of the pump system from the power meter, obtain a measurement of the instantaneous flow rate of the pump system from the flow meter, determine an SEC of the pump system based on the measurements of instantaneous power consumption and instantaneous flow rate, and provide an output to adjust the speed of one or more pumps in response to the determined SEC of the pump system. The pump control unit may be configured to repeatedly perform the above listed steps to seek a reduced value of the instantaneous SEC of the pump system.

The pump control unit may further perform any of the various methods described above, e.g., such as adjusting the pump speeds according to a change direction, setting the change direction to an opposite direction if the current instantaneous SEC is larger than the previous SEC, limiting the speed of the group of pumps to fall between a low or high threshold, modifying the size of speed adjustments, changing the rotational speed of a group pumps (e.g., in the case of centrifugal pumps), etc.

Other embodiments relate to a computer-readable memory medium that comprises program instructions executable to perform the operations described above.

Embodiments of the invention also relate to controlling a plurality of pumps in a pump system. The method may include the following steps: (a) setting a change direction to one of increasing or decreasing; (b) measuring instantaneous power consumption of the pump system; (c) measuring instantaneous fluid flow rate of the pump system; (d) determining a current instantaneous SEC of the pump system based on the instantaneous power consumption of the pump system and the instantaneous fluid flow rate of the pump system; (e) comparing the current instantaneous SEC of the pump system to a previous instantaneous SEC of the pump system; (f) setting the change direction to the opposite direction if the current instantaneous SEC of the pump system is greater than a previous instantaneous SEC of the pump system; and (g) adjusting speed of a pump of the plurality of pumps according to the change direction. In step (h), steps (b)-(g) may be performed a plurality of times for a respective pump in the pump system. Steps (a)-(h) may be performed a plurality of times for each pump in the plurality of pumps, preferably one pump at a time. In one embodiment, steps (a)-(h) are performed a plurality of times for respective plural subsets of the plurality of pumps.

BRIEF DESCRIPTION OF THE DRAWINGS

A better understanding of embodiments of the present invention can be obtained when the following detailed description of the preferred embodiment is considered in conjunction with the following drawings, in which.

Figure 1:
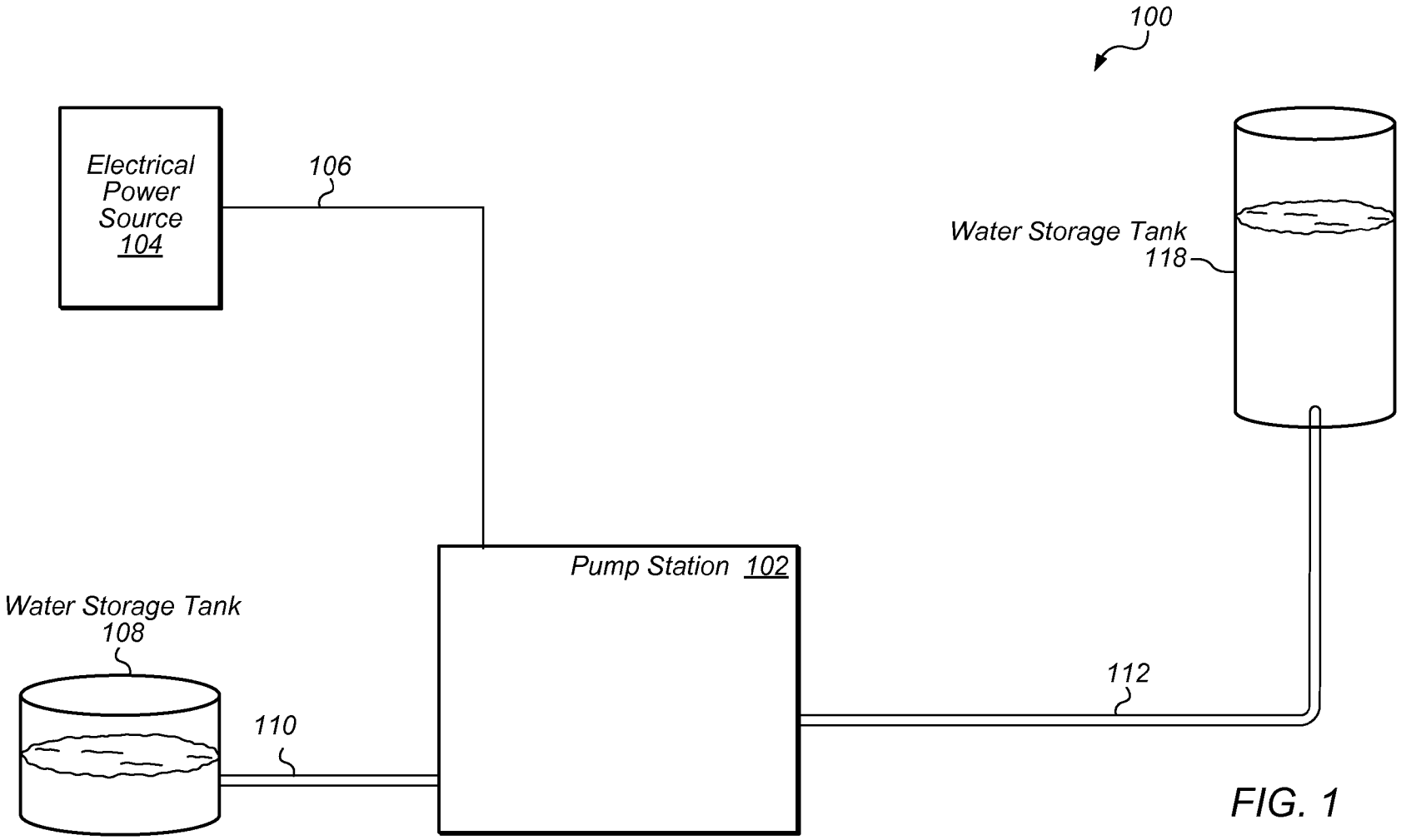
FIG. 1 illustrates an exemplary pumping system in which an embodiment of the invention may reside.

While the invention is susceptible to various modifications and alternative forms, specific embodiments thereof are shown by way of example in the drawings and are herein described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE EMBODIMENTS

In the following description, numerous specific details are set forth to provide a thorough understanding of the present invention. However, one having ordinary skill in the art should recognize that the invention may be practiced without these specific details. In some instances, well-known circuits, structures, and techniques have not been shown in detail to avoid obscuring the present invention.

As discussed in more detail below, certain embodiments include a technique for controlling one or more pumps for the continual improvement of energy efficiency. In some embodiments, the following features and capabilities may be utilized to achieve improved energy efficiency of a pump system: the ability to automatically measure or estimate instantaneous fluid flow rate, the ability to measure or estimate instantaneous power consumption and ability to adjust the speed of one or more pumps through adjustable speed drive (ASD) techniques including variable frequency drives (VFDs), variable transmissions or by other means. In some embodiments, the instantaneous fluid flow rate may be, for example, the flow rate of fluid going through a pump or going through a group of pumps or going through a pump station. The instantaneous fluid flow rate may be the fluid flow rate measured or sampled over a short period of time. In some embodiments, the instantaneous fluid flow rate may be a composite value based on (or derived from) multiple fluid flow rate figures. In some embodiments, the instantaneous power consumption may be, for example, derived from an electrical power reading (e.g., a sampled electrical power reading) associated with a pump or a collection of pumps or a pump station. In some embodiments, the instantaneous power consumption may be derived from reading(s) from the ASDs themselves. In some embodiments, the instantaneous electrical power consumption may be estimated based on readings of one or more currents in the power connection(s) to the ASD(s). In some embodiments, instantaneous power consumption may be derived from fuel flow rates. In some embodiments, each pump (e.g., in the group of pumps or in the pump station) may be powered using a dedicated ASD while in other embodiments an ASD may be shared (e.g., by a group of pumps or by a pump station).

Some embodiments may include a hardware computer-based controller (e.g., programmable logic controller (PLC)). The controller may be able to receive (e.g., periodically, continuously) values or signals representing instantaneous fluid flow rate measurements and the controller may also be able to receive (e.g., periodically, continuously) values representing power consumption figures. The controller may also be able to sample flow rates and power consumptions to support the execution of an algorithm. Also, the controller may be able to calculate (e.g., through an appropriate application and/or through circuitry) the energy consumption per volume of fluid pumped. In some embodiments, the controller may be able to adjust the speed of one or more pumps (e.g., continuously, periodically or on-demand) to minimize energy consumption per volume of fluid pumped.

Some embodiments of the invention may assess pump efficiency and system efficiency by automatically (and, for example, regularly) measuring (or estimating) fluid flow rate (e.g., of a pump, of a set of pumps) and continually measuring (or estimating) incoming power (e.g., used to operate the pump, used to operate a set of pumps). With these two values (e.g., fluid flow rate, incoming power) a pump controller (e.g., a PLC) may be able to automatically calculate energy required per unit volume of fluid. The energy required to pump a volume of fluid may be described in terms of Specific Energy Consumption (SEC). Specific Energy Consumption may be defined as the amount of energy required to make a specific amount of product. Thus the SEC of a pump system may defined be the amount of energy required to pump a volume of fluid from one location to another. In some embodiments, continually seeking to reduce the SEC of a pump system, as system demands change during operation, may lead to improvements in the energy efficiency of the system.

In some embodiments, a pump controller may be programmed to continually (e.g., periodically, regularly, on-demand) adjust the speed of an associated pump or group of pumps in response to SEC measurements and—once an appropriate speed for an energy efficiency target has been attained—periodically make slight speed adjustments to determine if running the pump at a different speed (e.g., in response to varying system conditions) may be beneficial in terms of improved energy efficiency.

In many embodiments, the properties of a pump system (e.g., as may be represented by a system curve) may be dynamically changing (e.g., water tanks may be filling and draining and system demands may be varying). Therefore, it may be beneficial to alter pump speed to locate a new operating point with improved energy efficiency. Furthermore, certain embodiments may include additional features. For example, in certain embodiments, once an energy efficiency target has been attained for a group of similar pumps running simultaneously, the speed of each pump may be varied independently to determine individual pump speed settings that may further improve energy efficiency. Also, in certain embodiments, if system demand increases and a flow rate increase is demanded, control software may determine a more suitable (e.g., a more efficient) number of pumps to run to meet the new system conditions. For example, four pumps running at peak efficiency and producing flow Q1 may be less efficient than three pumps producing Q1 by running faster than their peak efficiency. The software may develop heuristic models of the system in varying system states to determine when to adjust number of pumps in response to varying demand.

Also, in some embodiments, a pump controller may for a period of time (e.g., for as long as is warranted by system demand) focus on satisfying a high level of demand to the possible detriment of energy efficiency. In this manner, the peak capacity of the pump station may be maintained. Typically, for a water supply utility, peak demand periods account for less than 2% of pump station operation, so sub-optimal efficiency during peak demand times may not significantly impact overall energy costs.

Embodiment Illustrations

FIG. 1 illustrates an exemplary system which may utilize embodiments of the invention. FIG. 1 depicts a pumped water system 100 that includes a water pump station 102 supplied with electrical power via electrical supply line 106 from electrical power source 104. In the depicted embodiment, pump station 102 is connected, via piping 110 to storage tank 108. Pump station 102 is also connected via piping 112 to storage tank 118. Piping 110 and 112 may include relatively wide pipes, (e.g., 24 inch diameter pipes). Storage tank 108 may be a water storage tank (e.g., ground storage tank) that may hold a relatively large quantity of water (e.g., 2 million gallons (MG)) and may be relatively low in height (e.g., 35 feet tall) and may located at a moderate elevation (e.g., 915 feet above sea level). Storage tank 118 may also be a water storage tank (e.g., a mountain storage tank) that may also hold a relatively large quantity of water (e.g., 2 MG) and may be taller (e.g., 105 feet tall) than storage tank 108 and may be located at a higher elevation (e.g., 1200 feet above sea level) than storage tank 108. Pump station 102 may be located quite far from storage tank 118, and water pipe 112 may be quite long (e.g., 40,000 feet). Pump station 102 may be designed to pump water from storage tank 108 to storage tank 118 that may be, as already indicated, taller than storage tank 108 and located at a higher elevation than storage tank 108. Consequently, pump station 102 may be employed to raise water from one storage tank to another. Electrical energy provided by source 104 may provide the power that pump station 102 may use to perform the pumping. While the depicted embodiment is described as pumping water between storage tanks, other embodiments may be employed to pump other fluids or gases between storage tanks or other forms of fluid sources and destinations, and yet other embodiments may be employed to pump fluids and gases to support a manufacturing process or a chemical process. The pump station 102 may utilize embodiments of the invention as described herein to provide for increased energy efficiency of the pump system 100.

Figure 2:
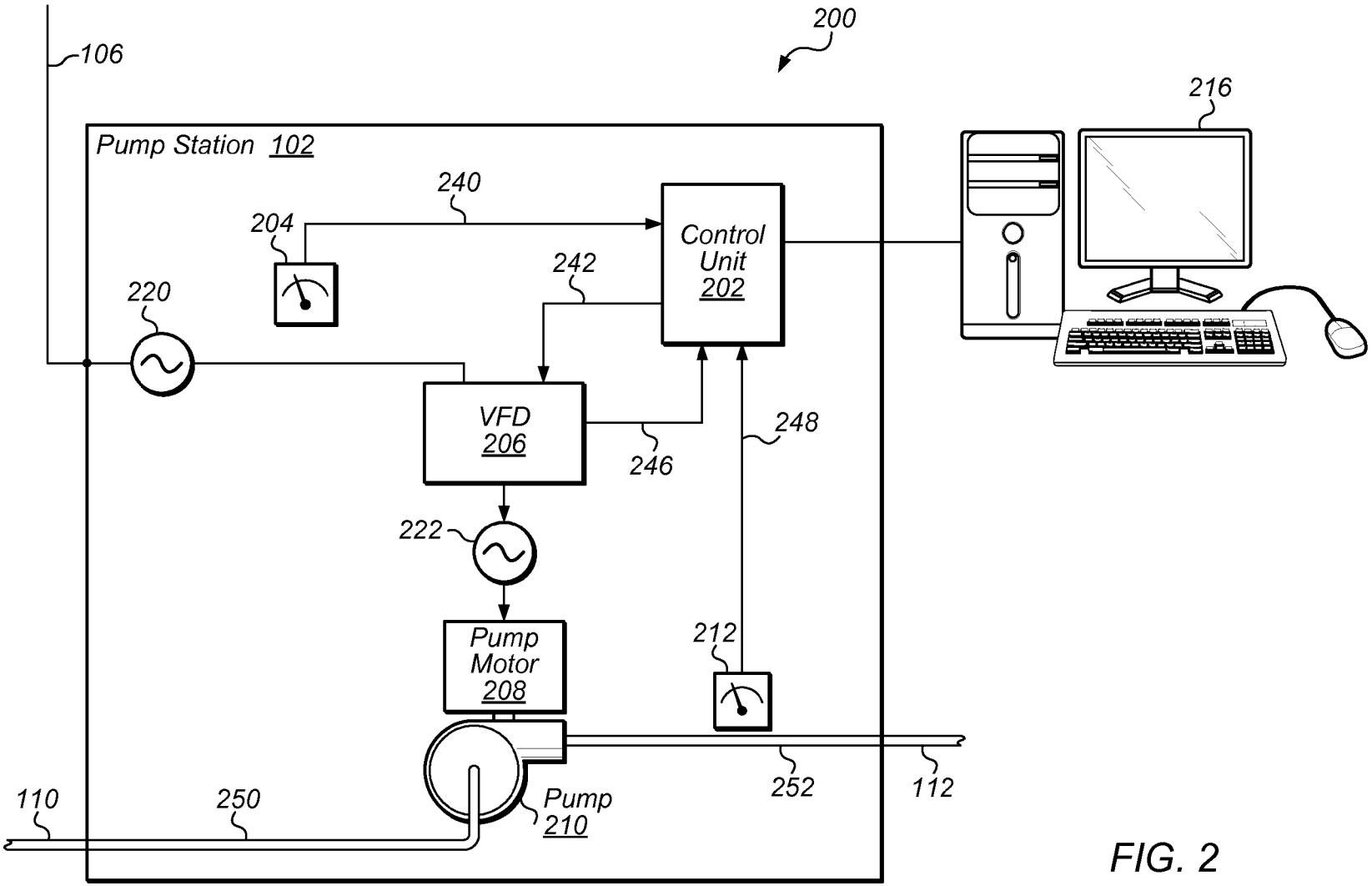
FIG. 2 is a block diagram of a pumping system according to one or more embodiments of the invention.

FIG. 2 depicts a block diagram of exemplary pump station 102 according to some embodiments of the invention. In the depicted embodiment, pump station 102 includes the following sub components; power meter 204, control unit 202, VFD 206, pump motor 208, pump 210 and fluid flow meter 212. In the depicted embodiment, pump station 102 may receive electrical power (e.g., electrical alternating current (AC) power) via power connection 106. In some embodiments, power connection 106 may connect pump station 102 to a local generating device (e.g., a local power generator, diesel electric generator). In other embodiments, power connection 106 may connect pump station 102 to remote generating device (e.g., a power station via a power grid and a local power transformer). In some embodiments, power connection 106 may provide connections to multiple power sources and these multiple power sources may be used together or individually by pump station 102.

In the depicted embodiment, power connection 106 is connected to VFD 206 by power wiring 220. VFD 206 is connected to pump motors 208 by power wiring 222. In some embodiments, electrical power may be provided by power connection 106 to VFD 206 by power wiring 220. Power meter 204 may measure (e.g., periodically, intermittently, continuously, on-request) the electrical power provided to pump station 102 (e.g., through electrical connection 106, through power wiring 220) and may send power readings to control unit 202 via connection 240. In some embodiments, VFD 206 may supply power to pump motor 208 via power wiring 222 and pump motor 208, attached to pump 210, may drive pump 210 according to the power supplied. In some embodiments, multiple pump motors (e.g., multiple pump motors 208) (and associated pumps) may be connected to one or more VFDs (e.g., VFD 206) and the VFD may drive (e.g., supply power to) the multiple connected pump motors. In some embodiments, other methods of controlling the speed of the pump may be employed (e.g., the pump may be powered by a pump motor coupled to a variable transmission) so that embodiments are not limited to systems with a pump driven by a VFD-controlled motor.

In the depicted embodiment, pump station 102 is connected to supply pipe 110 that may be used to supply fluid (e.g., water) to pump 210 via pump station piping 250. In the depicted embodiment, the output of pump 210 is connected, via pump station piping 252, to pipe 112 connected to pump station 102. Flow rate meter 212 may measure (e.g., periodically, intermittently, continuously, on-request) the flow rate of fluid (e.g., through pump station piping 252, through piping 112) that is pumped by pump 210 and may send flow rate readings to control unit 202 via connection 248.

In the depicted embodiment, control unit 202 is connected to power meter 204 by connection 240, is also connected to flow meter 212 by connection 248 and is also connected to VFD 206 by connections 242 and 246. In some embodiments, control unit 202 (e.g., a programmable logic controller, an embedded computer running a real-time operating system) may receive (e.g., periodically) power readings from power meter 204 via connection 240, may receive (e.g., periodically) flow readings from fluid flow meter 212, may receive status information (e.g., intermittently) from VFD 206 via connection 246 and control unit 202 may send control information to VFD 206 via connection 242. Control unit 202 may control the operation of VFD 206 and thereby change the power output of pump motor 208 and the speed of pump 210. Control unit 202 may use the power and flow readings (e.g., readings taken in real time, periodic readings) to control (e.g., automatically control, control according to an algorithm, control according to a predefined methodology, control in real time) the operation of pump 210 to obtain improvement (e.g., continuous improvement) in energy efficiency. As depicted in FIG. 2, system 200 may also includes a computer 214 that may be connected (e.g., wirelessly, by a network connection, occasionally connected) to control unit 202. In some embodiments, the operation of control unit 202 (e.g., the control algorithm performed by control unit 202) may be obtained from instructions or information downloaded from computer 214, that may be occasionally connected to control unit 202.

Other embodiments of pump station 102 may include multiple pumps, multiple sets of pumps, multiple ASDs connected to one or more control units. In some embodiments, multiple power and flow meters may be used. For example, in certain embodiments, each pump may have an associated power and flow meter.

Figure 3:
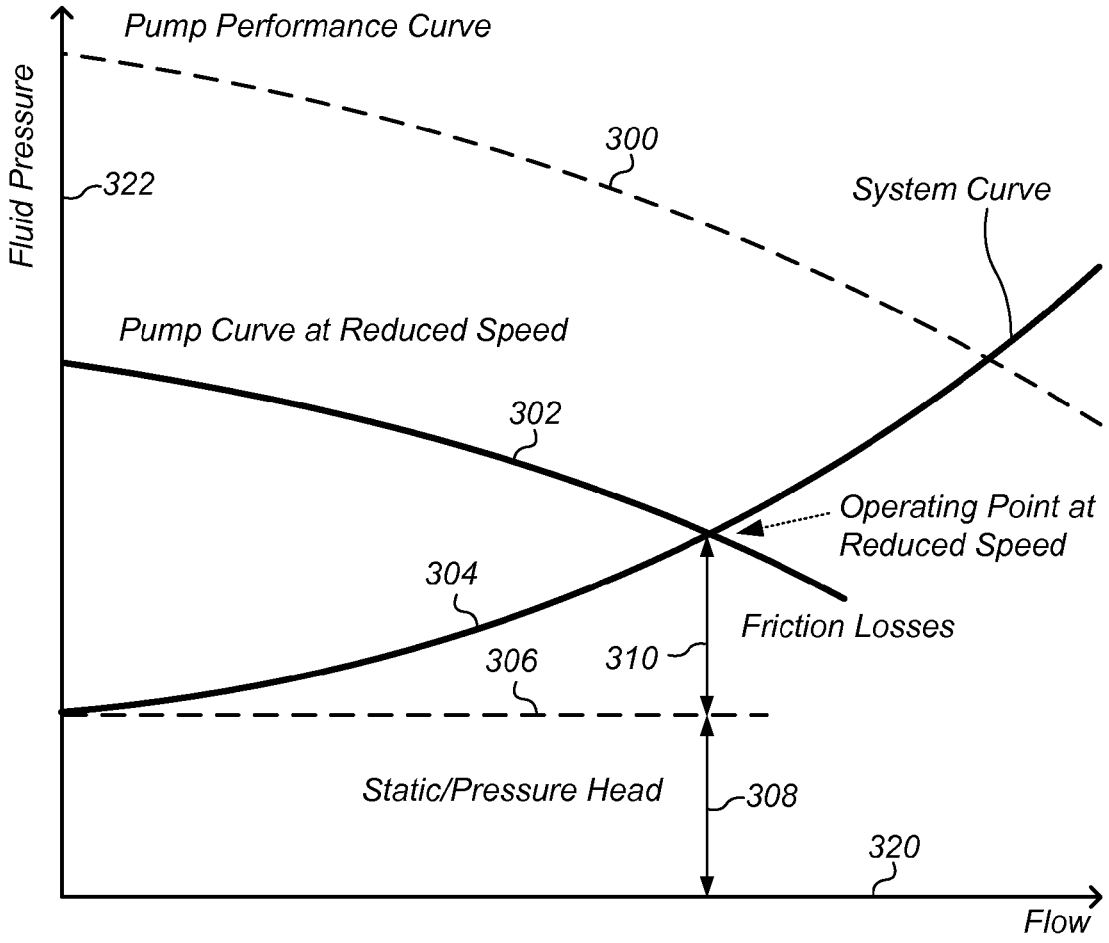
FIG. 3 is a chart of fluid pressure versus flow rate showing pump performance and system curves.

FIG. 3 depicts a chart that illustrates the behavior of a variable speed centrifugal pump operating within a given pumped fluid system in accordance with various embodiments. On FIG. 3, horizontal axis 320 represents fluid flow rate and vertical axis 322 represents fluid pressure. Curve 300 represent operating characteristics of an exemplary variable speed pump running at a certain speed (e.g., 1500 revolutions per minute (RPM)). Curve 302 represents the same variable speed pump running at a slower speed (e.g., 1200 RPM). Additional curves (not depicted) may exist for the same variable speed pump running at other speeds (e.g., 1300 RPM, 900 RPM). Typically, curves 300 and 302 are dependent on the design of the pump but are independent of the pump's operating environment (e.g., characteristics of the piped fluid system the pump operates within). The speed of a pump (running within its operational range) may be largely determined by the power output of an engine driving the pump. For example, curve 300 may correspond to the pump's engine producing 15 HP and curve 302 may correspond to the pump's engine producing 10 HP. On FIG. 3, curve 304 represents relationship between pressure and flow rate (e.g., fluid flow rate) for the given pumped fluid system. The pumped fluid system may comprise various pipes and storage tanks Curve 304 represents the relationship between fluid pressure and fluid flow rate at the pump within the given system. The fluid pressure may be divided into two components—a static component (as indicated by arrow 308) and dynamic component (as indicated by arrow 310). For the given pumped fluid system, dashed line 306 represents the portion associated with the static component (e.g., the pressure required to move fluid in the system at a near zero flow rate). In general, the greater the elevation to which fluid is pumped the greater is static component 308 and the higher is representative dashed line 306. As the flow of fluid increases, friction (e.g., friction in pipes, against pipe walls) generally increases so the dynamic component of system curve 304 increases with increased flow rate. The point at which "system" curve 304 meets "pump" curve 300 may be referred to as an operating point of the pumped fluid system. A second operating point may be where "system" curve 304 meets "pump" curve 302, albeit the second point represents a lower pump speed, lower pump engine power and lower fluid flow rate.

Figure 4:
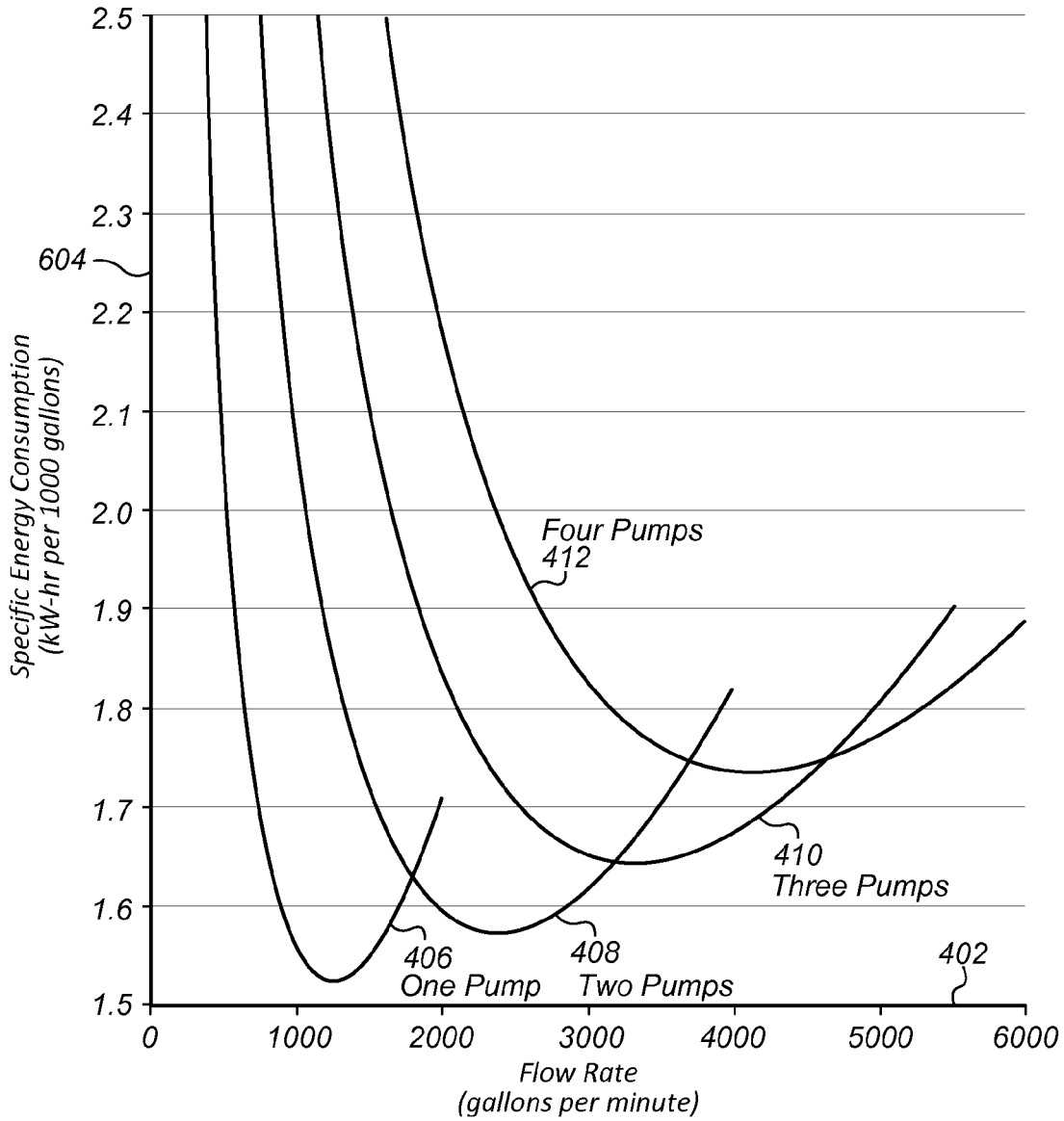
FIG. 4 is a chart of SEC versus flow rate showing curves for 1, 2, 3 and 4 pumps.

FIG. 4 depicts a chart that illustrates the relationship between the Specific Energy Consumption (SEC) of pumping (e.g., kW-hr per 1000 gallons) versus fluid flow rate (e.g., the flow rate produced by the pumping) for an exemplary pump system according to one or more embodiments. On FIG. 4, horizontal axis 402 represents fluid flow rate (e.g., gallons per minute) and vertical axis 404 represents SEC (e.g., kW-hr per thousand gallons). Curve 406 represent the relationship between SEC (e.g., of a pump station) and flow rate (e.g., through a pump station) for a single pump pumping fluid in the exemplary system. Curves 408, 410, 412 represent the relationship between SEC and flow rate for two, three and four pumps respectively. The reader may note the following aspects the curves depicted in FIG. 4. All curves 406-412 appear to have a similar shape and each appears to taper towards a single point of minimum SEC (power consumed per 1000 gallons). For example, in the depicted example, the minimum energy consumption operating point for curve 406 is approximately at 1200 gallons per minute at an SEC of approximately 1.525 kW-hrs per 1000 gallons. Note that, the more pumps that are used to pump (e.g., in the exemplary system) the higher the maximum flow rate that may be obtained and the higher the minimum SEC. For each curve 406-412, SEC rises rapidly at the lowest flow rates. Those skilled in the art will appreciate that when a pump runs sufficiently slowly, little or no fluid may be moved but the pump may still consume considerable energy.

Of particular interest in FIG. 4 is the shape of curves 406-412 and the tapering of each curve towards a point of minimum SEC. By altering the speed of a pump, or pumps, and measuring the effect of the speed adjustment on flow rate (e.g., through a pump station) and energy consumption (e.g., of a pump station), thereby calculating an SEC value associated with the pump system, embodiments may be able to find the operating point of minimum SEC by an iterative process. Furthermore, through an understanding of the general shape of SEC versus flow rate curves (e.g., curves 406-412), embodiments may need little or no specific knowledge of a pump (e.g., a pump curve such as pump curves 300, 302, a pump efficiency curve) and/or little or no specific knowledge of a pump system (e.g., a system curve such as system curves 304) and/or little or no other information pertaining to a particular pump system or pertaining to a type of pump system.

Figure 5:
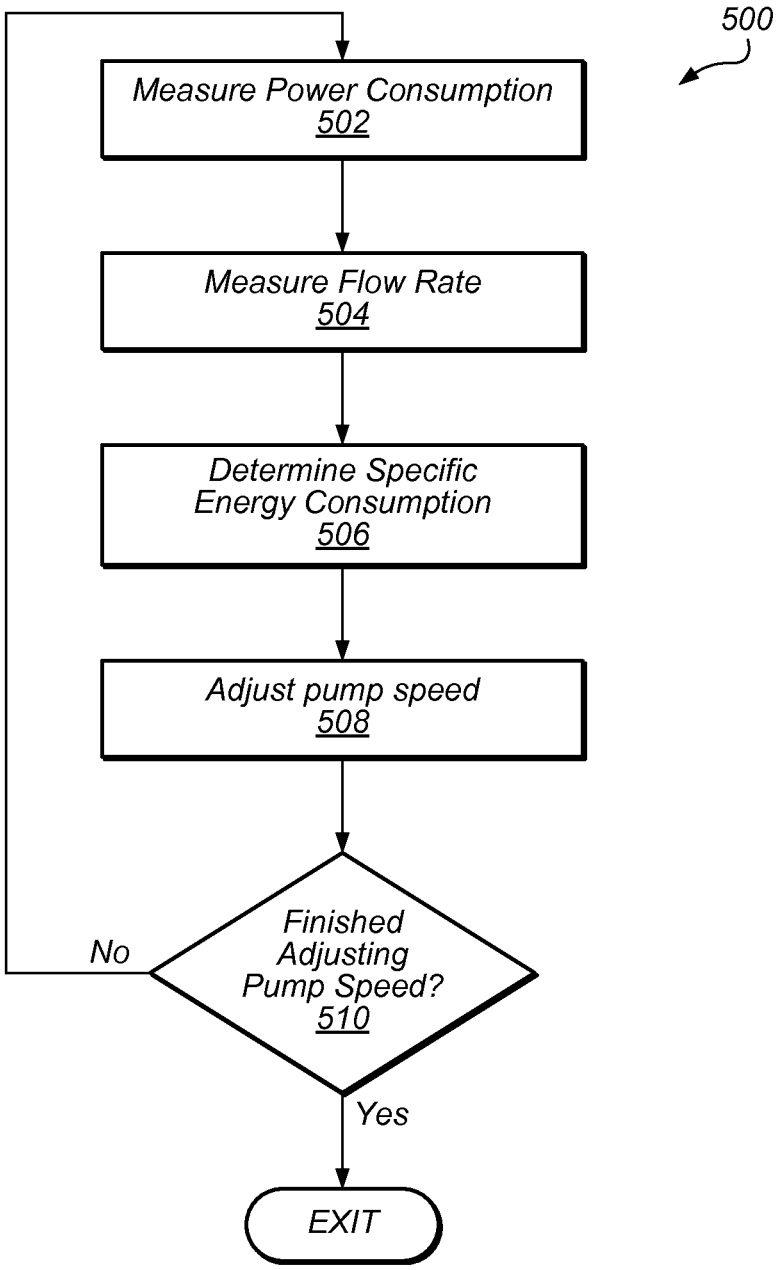
FIG. 5 is a flow chart illustrating a method for controlling pumps according to one or more embodiments of the invention.

FIG. 5 depicts a flowchart of an exemplary method 500 of controlling one or more pumps according to some embodiments of the invention. Method 500 may include block 502 where power consumption may be measured. In some embodiments the power consumption may be, for example, the power consumption of a pump, the power consumption of a group of pumps, or the power consumption of a pump station. In some embodiments, the power consumption measured may reflect the power measuring capabilities of an embodiment rather than the number of pumps being controlled. For example, in an embodiment where one pump is being controlled in a pump system containing twenty pumps, the power consumption measured may be the power consumption of all twenty pumps. Since some embodiments may operate in changing environments, and power consumption may fluctuate, some embodiments may measure "instantaneous" power consumption (e.g., power consumption measured over a short period of time, power consumption measured within a specific time interval, a single power measurement).

In depicted method 500, flow may proceed from block 502 to block 504 where flow rate of fluid is measured. In some embodiments the flow rate may be, for example, the flow rate corresponding to a single pump, the total flow rate of a group of pumps, or the flow rate of a pump station. In some embodiments, the flow rate measured may reflect the flow rate measuring capabilities of an embodiment rather than the number of pumps being controlled. For example, in an embodiment where two pumps are being controlled in a pump station containing ten pumps, the flow rate measured may be the flow rate of the pump station (e.g., all ten pumps). Since some embodiments may operate in a dynamic environment, and flow rate may change rapidly, some embodiments may measure "instantaneous" flow rate (e.g., flow measured over a short period of time, flow rate measured within a specific time interval, a flow rate measurement).

In depicted method 500, flow may proceed from block 504 to block 506 where SEC may be determined. In some embodiments, SEC may be determined from a flow rate measurement (e.g., the flow rate measured in block 504) and a power consumption measurement (e.g., the power consumption measured in 502). SEC may be determined in various ways (e.g., by dividing a power consumption by a flow rate, by a lookup table, by digital logic, analog circuitry). The type of SEC may reflect the scope of measurements used to determine SEC, so that, for example, pump measurements may be used to determine the SEC of a pump and pump station measurements may be used to determine the SEC of a pump station. In some embodiments, a single pump or a group of pumps may be controlled using a pump station SEC.

In some embodiments, SEC may be considered to be instantaneous SEC (e.g., when SEC is calculated using an instantaneous flow rate and an instantaneous power consumption). It may be beneficial (e.g., to the accuracy of instantaneous SEC) that both the instantaneous flow rate and the instantaneous power consumption measurements that are used to calculate instantaneous SEC are taken within a suitably short period of time, particularly in a dynamic environment. Although depicted method 500 shows blocks 502, 504 and 506 as separate blocks in a fixed other, operations within these blocks are closely related and may, in some embodiments, form part of one process step, or may in some embodiments, occur in a different order.

From block 506 in the depicted embodiment, flow may proceed to block 508 where pump speed may be adjusted. In some embodiments, pump speed may be adjusted with a goal of finding a speed corresponding to a lower SEC. In some embodiments, pump speed may be continually adjusted with a goal of finding a speed that results in minimum SEC. Pump speed may be adjusted in one of two directions, increasing or decreasing. In some embodiments, the direction of adjustment depends on a comparison of a current SEC with a previous SEC. In some embodiments, if the current SEC is lower than a previous SEC the direction of speed adjustment may be maintained (e.g., if the speed was being increased, it may continue to be increased, if the speed was being decreased it may continue to be decreased). In some embodiments, if the current SEC is higher than a previous SEC the direction of speed adjustment may be set to the opposite direction (e.g., if the speed was being increased, it may now be decreased, if the speed was being decreased it may now be increased).

In some embodiments, the speed may be adjusted using various techniques (e.g., by adjusting by a step size quantity, by adjusting by a varying step size quantity, by limiting (e.g., clamping) the step size quantity between two thresholds, by limiting (e.g., clamping) the pump speed between two thresholds). In one embodiment, the method in 508 may modify the direction of speed adjustment and may also dynamically modify the amount of adjustment, e.g., based on the difference between current SEC and the previous SEC. For example, the greater the difference between current SEC and the previous SEC, the larger the speed adjustment. Correspondingly, the smaller the difference between current SEC and the previous SEC, the smaller the speed adjustment.

Figure 6:
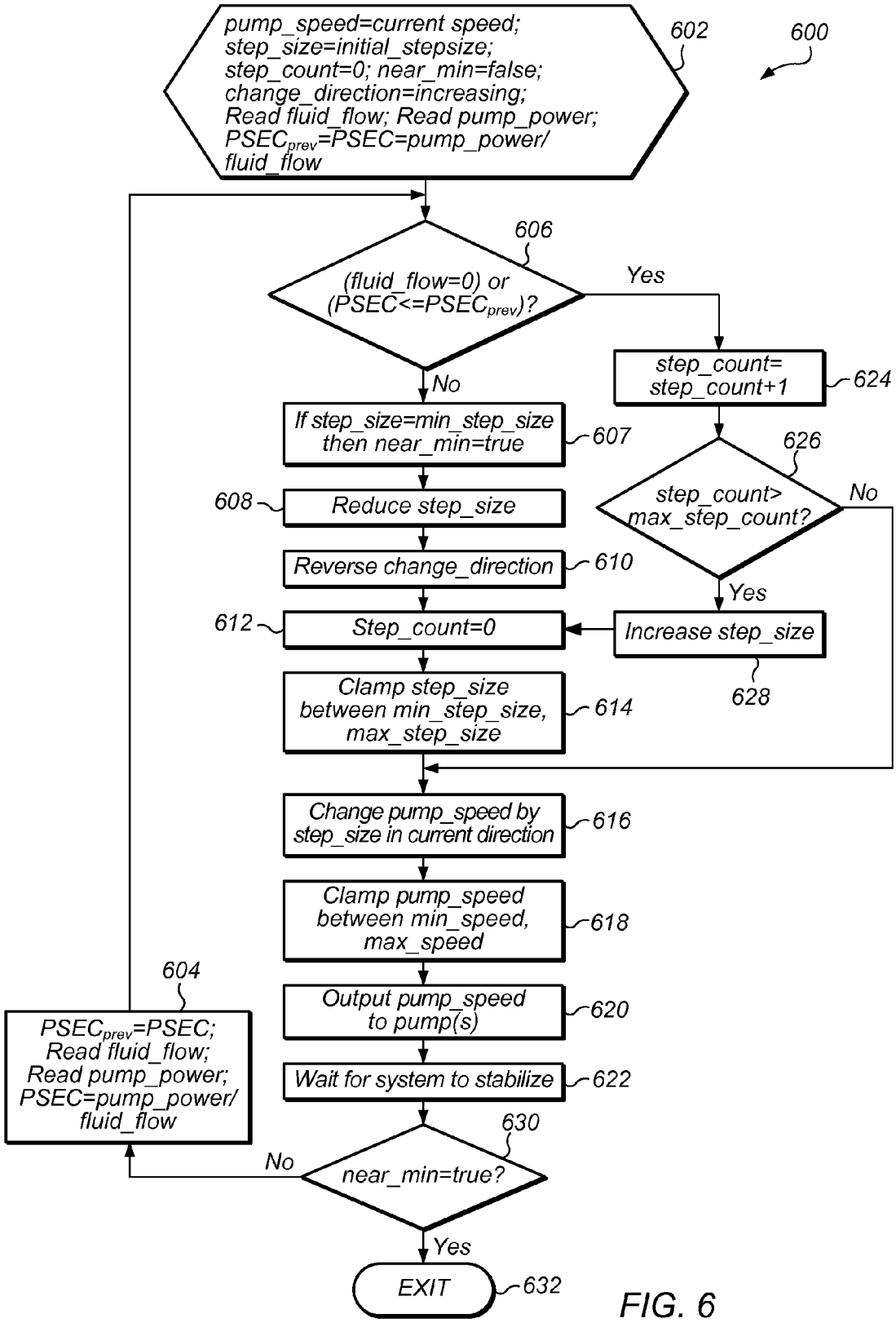
FIG. 6 is a flow chart illustrating a method for controlling pump speed according to one or more embodiments of the invention.

FIG. 6 and accompanying text describe some embodiments of speed adjustment in more depth. In some embodiments, method 500 may be employed to control varying numbers of pumps (e.g., a single pump, a small group of pumps, a large group of pumps, all the pumps in a pump station). Consequently, with regard to adjusting the speed of pumps, embodiments (e.g., method 500) may, for example, adjust the speed of a single pump, or a group of pumps together, or each pump in a group of pumps in sequence.

Following block 508 in depicted flow 500, comes decision block 510. If it is determined in block 510 that no more speed adjustments are to be made (e.g., made at the present time, made to presently selected pump(s)) then the flow may exit. Alternatively, if it is determined in block 510 that more speed adjustments are to be made (e.g., one more speed adjustment, a limited number of speed adjustments) then flow proceeds back to block 502 and another iteration of method 500 may be made. As previously mentioned, in some embodiments, a goal of performing speed adjustments (e.g., executing method 500) may be to seek lower SEC, and repeated speed adjustments may be made to seek lower and lower SEC. At some stage, it may be determined that the current SEC is sufficiently close to a minimum SEC. As used herein, the current SEC may be "sufficiently close" to a minimum SEC if the current SEC is determined to be within 1% of the minimum SEC, or within 2% of the minimum SEC, or within 5% of the minimum SEC. In some embodiments, this condition may used to decide that no further speed adjustments are to be made (e.g., at least for the present time) and the method may exit.

FIG. 6 depicts a flow chart of an exemplary method 600 of controlling one or more pumps according to some embodiments of the invention. In the depicted flow, the current (e.g., most recent, most recently determined, determined from recent measurements) indicator of SEC (e.g. SEC of a pump system) is represented by variable PSEC. So, in method 600, the value of PSEC may be considered indicative of the amount of energy used by a pump station to move a certain volume of liquid. As the energy efficiency of the pumping system may vary with time (e.g., as operating conditions change), so the value of PSEC may change (e.g., in response to changing power consumption measurements and changing flow rate measurements). When, in method 600, the value of the PSEC variable is updated (e.g., according to recent measurements), the previous value of PSEC may be held in variable PSECprev. In some embodiments, pump energy and fluid volume may be measured using various units (e.g., joule, kilowatt-hour, watt-minute, liter, gallon etc.) and other terms equivalent to PSEC and PSECprev may be employed using various units (e.g., joules per liter, kilowatt-hours per 1000 gallons, etc.).

Exemplary method 600 includes initialization block 602 that may assign initial values to method variables. The variables used in exemplary method 600 may be initialized in block 602 as follows. Variable "pump_speed" (which may be used to set the speed of a pump (or group of pumps)) may be assigned to the current speed of a pump (or to the current average speed of some pumps). Variable "step_size" (which may be used to hold the value by which pump_speed is adjusted (e.g., increased, decreased)) may be assigned to an initial value (e.g., initial_stepsize). The value of initial_stepsize and other initialization variables may be supplied to method 600 by a variety of means (e.g., as a command argument, as a passed parameter, user input). Variable "step_count" (which may be used to count the number of times, in a row, that a given value of step_size is used) may be assigned to zero. Boolean variable "near_min", (which may be used to determine if the method 600 has essentially completed and thus may exit) may be assigned to "false". Note that some embodiments may operate (e.g., execute a method such as method 600) continuously, and may not use a variable such as "near_min" to exit. Variable, "change_direction" (which may be used to determine if the pump speed is to be increased or decreased) may be assigned to "increasing".

In addition, in block 602, the variable "fluid_flow" which may represent a flow rate associated with the pump (or pumps) being controlled may be updated (e.g., by a flow measurement being performed). In some embodiments, fluid_flow may correspond to the flow rate of an entire pump station in which a controlled pump resides. In some embodiments, fluid_flow may correspond to the flow rate of a group of pumps, or even a single pump in a pump station. In some embodiments, fluid_flow may correspond to the flow of a group of pumps (e.g., a pumping station) in which one or more pumps of the group of pumps are not controlled by an embodiment. Various techniques and measuring devices may be used to measure flow rate, so that, for example, in some embodiments the flow rate measured may be considered to be an "instantaneous" flow rate, approximating to the flow rate over a short period of time. A single flow rate measurement taken by a flow meter may be considered to be an instantaneous flow rate.

Further, in block 602, the variable "pump_power" is updated (e.g., by a power measurement being performed, by a power measurement being received). In some embodiments, pump_power may correspond to power/energy consumption of an entire pump station in which a controlled pump resides. In some embodiments, pump_power may correspond to the power/energy consumption a group of pumps, or even a single pump in a pump station. Since power consumption may vary over time, the power consumption represented by pump_power may, in some embodiments, be instantaneous power consumption (e.g., sampled power consumption, power consumption measured over a short period of time). In some embodiments, pump_power may correspond to the power/energy consumption of a group pumps (e.g., a pumping station) in which a controlled pump resides and in which un-controlled pumps reside. Lastly, in block 602, the variables PSEC and PSECprev may be assigned to the ratio of pump_power to fluid_flow.

In depicted method 600, flow proceeds after initialization block 602 to decision block 606 in which the current (e.g., most recently determined, present) values of PSEC and PSECprev may be compared. In some embodiments, block 606 may be used to determine if, with respect to an SEC versus flow rate curve (e.g., 406, 408, 410, 412), a minimum SEC point has been crossed. For example, in one embodiment, as pump speed is changed in one direction (e.g., increased) to increase energy efficiency (e.g., to reduce SEC) there may come a point where a change in pump speed (e.g., an increase in pump speed) causes a decrease in energy efficiency (e.g., an increase in SEC). In this case, the check performed at block 606 may detect such a situation and an appropriate response taken (e.g., the "No" branch at block 606 may be taken). If, at block 606, PSEC is found to be equal to or less than PSECprev (e.g., energy efficiency has increased or stayed the same) or if the value of fluid_flow equals zero (e.g., suggesting the pump may be starting operation), flow may proceed to block 624; if not (e.g., energy efficiency has decreased), flow may proceed to block 607.

Note that in depicted method 600, a single set of criteria are shown in block 606 "(fluid_flow=0) or (PSEC<=PSEC prev)?" However, in some embodiments multiple sets of criteria may be used. For example, a first set of criteria may be used in block 606 when change_direction is set to "increasing" and a second set of criteria may be used in block 606 when change_direction is set to "decreasing". Multiple sets of criteria may be used for various purposes including, for example, providing hysteresis.

In exemplary method 600, block 607 may involve checking the value of step_size (which may change as the method is performed) against the value of min_stepsize, and if found to be equal, block 607 may also involve setting the value of Boolean variable near_min to "true". As depicted method 600 progresses, the value PSEC may approach a "minimum" SEC value (e.g., a local minimum value, a value corresponding to the minimum of an SEC versus flow rate curve) and, as it does so, the value of step_size may be reduced (e.g., in block 608). In some embodiments, the proximity of PSEC to a minimum value of SEC may be indicated by the value of step_size and, if step_size is determined to be sufficiently small (e.g., step_size equal min_stepsize), PSEC may be considered to be "fully adjusted". Consequently, variable near_min, when set to "true", may be considered an indicator that PSEC is "fully adjusted".

In depicted method 600, block 607 is followed by block 608 in which the value of variable "step_size" may be reduced. In some embodiments, step_size may represent an absolute value (e.g., 100 revolutions per minute) while in other embodiments step_size may represent a fractional value (e.g., 1% of the maximum rated speed of the pump, 2% of current pump speed). In some embodiments (e.g., pumps controlled by a VFD), step_size may relate to the power used to drive a pump or group of pumps (e.g., 1% decrease in alternating current (AC) power frequency, 1/10 Hz increase in AC power frequency). Step_size may be reduced (e.g., by a percentage, to an allowable lower level, to an enumerated lower level) to provide finer granularity allowing the method 600 to close in on a "minimum" SEC value. Note that the minimum SEC may not correspond to an optimally reduced SEC or an absolute minimum value of SEC. Rather, a "minimum" value may be a value (e.g., a local minimum, one of a number of minimums, a target minimum) to which an embodiment may move towards. Step_size may be increased (e.g., by a percentage, to an allowable higher level, to an enumerated higher level) to allow method 600 to expedite movement to a minimum value.

In the depicted method 600, flow proceeds from block 608 to block 610 in which the direction of pump speed change may be reversed (e.g., variable change_direction may be switched from "increasing" to "decreasing" or switched from "decreasing" to "increasing"). As previously mentioned, the "No" branch at block 606 may indicate that the last change of pump speed, rather than causing a reduction in SEC, actually caused an increase in SEC. This may be visualized as moving past a point of minimum SEC on an SEC versus flow rate curve (e.g., 406, 408, 410, 412) and reversing the direction of change in block 610 may be visualized as reversing direction towards the point of minimum SEC. For example, in one embodiment, if a point of minimum SEC is crossed as pump speed is being decreased, block 610 may reverse the direction of change so that pump speed is now increased (e.g., variable change_direction is set to "increasing"). Alternatively, in one embodiment, if a peak efficiency point is crossed as pump speed is being increased, block 610 may reverse the direction of change so that pump speed is now decreased. In certain embodiments, reversing direction in block 610 may be performed, or partly performed by changing the polarity associated with the step_size variable.

Following block 610 in depicted method 600 comes block 612 in which variable step_count may be set to zero. In some embodiments, a method variable such as "step_count" may be used to restrict and/or control adjustments to another method variable (e.g., step_size). In depicted method 600, value max_steps is used to specify the maximum number of times (in a row) that variable pump_speed is adjusted by a specific value of step_size before step_size is increased. In the depicted embodiment, variable step_count may be used to count from zero to "max_steps+1". Following the decrease in step_size at block 608, step count may be set to zero at block 612.

In depicted method 600, the range of values for step_size is limited, in block 614, to fall within a range defined by two method thresholds "stepsize_max" and "stepsize_min." In some embodiments, it may be beneficial (e.g., for reasons of performance, accuracy, stability or functionality) for the size of pump speed adjustments (e.g., the size of incremental changes to pump speed) to be constrained within a certain range. This may be achieved by defining two thresholds (e.g., one low value, one high value) and limiting the size of incremental speed adjustments (e.g., limiting the range of values of step_size) to fall between the low value (e.g., stepsize_min) and the high value (e.g., stepsize_max). In block 614 of exemplary method 600, step_size may be "clamped" between the low value of stepsize_min and the high value of stepsize_max. In some embodiments, clamp limits may be defined by constants or variables or functions and they may vary with time.

In exemplary method 600, flow proceeds from block 614 to block 616 in which variable pump_speed, which represents the speed of a pump (or speed of a group of pumps), may be adjusted by a value specified by variable step_size. This adjustment may involve, for example, pump_speed being increased by a value corresponding to variable step_size or pump_speed being reduced by a value corresponding to variable step_size.

From block 616, flow proceeds to block 618, according to the depicted exemplary method 600. In some embodiments, it may be beneficial (e.g., for reasons of performance, accuracy, stability or functionality) for pump speed (e.g., the value of the pump_speed variable) to be constrained within a certain range. This may be achieved by defining two method values (e.g., one low value, one high value) and limiting the pump speed (e.g., limiting the range of values of variable pump_speed) to fall between the low value (e.g., min_speed) and the high value (e.g., max_speed). In block 618 of exemplary method 600, the pump_speed variable may be "clamped" between the value of min_speed and the value of max_speed. In some embodiments, pump_speed clamp limits may be defined by constants or variables or functions and they may vary with time. In some embodiments, if the speed of a pump falls to a sufficiently low value (e.g., 75% of the standard operating speed), the pump may not effectively add pressure or move fluid, and so this may suggest a min_speed value. In some embodiments, a pump may encounter reliability issues if it is operated at 10% over its maximum rated speed and so this may suggest a max_speed value.

In depicted method 600, flow proceeds from block 618 to block 620 in which an updated speed value (e.g., an updated value of variable pump_speed) may be applied to (e.g., output to) a pump or group of pumps. In some embodiments the speed value may be applied by sending control signals to one or more ASDs controlling the pump(s). Due to speed clamping or other factors, the updated pump speed may not differ from the previous pump speed. Depending on the direction of change the updated pump speed may be slower or faster than the previous pump speed.

Following block 620, in exemplary method 600, is block 622, which may involve waiting for a pump system to stabilize following the application of an updated speed value. Changing pump speed may result in a temporary disturbance of the system and waiting for a period may allow temporary pump system disturbances to dissipate before further measurements (e.g., fluid flow rate measurements) are made or further changes made. In some embodiments, waiting may involve waiting for a specified period (e.g., $1/10^{th}$ second, 1 second, 2 seconds) or waiting for signal or waiting for an indication that the fluid flow rate has stabilized. The period may be determined by making a speed step change and measuring system response time.

In the depicted method 600, flow proceeds from block 622 to decision block 630, in which the value of Boolean variable near_min may be compared to "true". If the value of near_min is determined to be equal to "true" (e.g., from being set to "true" in block 607), then no further iterations of method 600 may be performed and the method may be exited in block 632. If near_min is determined to be not "true" (e.g., is "false"), then flow may proceed to block 604. In some embodiments, methods similar to method 600 may continuously loop, (e.g., to respond to changes in the pump system) and may not use an exit variable such as near_min.

In exemplary method 600, block 604 involves updating variables fluid_flow, pump_power and PSEC and assigning PSECprev to the pre-update value of PSEC. In some embodiments, block 604 may involve measuring pump energy consumption and updating variable pump_power, measuring fluid flow rate and updating variable fluid_flow and calculating a new value for PSEC using updated pump_power and fluid_flow values. In some embodiments, updating PSEC may be regarded as sampling SEC.

In the depicted method 600, flow proceeds from block 604 to block 606 which has previously been described. Turning instead to the "Yes" branch at decision block 606, which may be taken when a change in pump speed causes an increase in pump energy efficiency (e.g., SEC is reduced); the "Yes" branch leads first to block 624. In block 624, the variable step_count may be incremented. This may be done with a view to limiting the number times in a row that a given step_size value is used. From block 624, flow proceeds to decision block 626, where the step_count variable may be compared to the value of max_steps. If the value of step_count is found, in block 626, to be less than or equal to max_steps, then more method iterations using the current value of step_size variable are allowed and the flow may proceed, as depicted, to block 616. From block 616 the flow proceeds as previously described. If the value of the step- _count variable is found to be greater than max_steps, then the flow may proceed, as depicted, to block 628, where the step_size variable may be increased. After block 628, the depicted flow proceeds to block 612, where the step_count variable may be reset to zero.

FIG. 6 depicted an exemplary method 600 of controlling pumps according to some embodiments of the invention. However, those skilled in the art will appreciate that other methods (or variants of depicted method 600) may be performed according to some embodiments of the invention. For example, in methods according to some embodiments, other factors (e.g., other pump system information) may be incorporated into the method flow. For example, pump system information may include fluid levels (in one or more tanks), flow rates at various locations, operational status (e.g., temperature, vibration levels) of one or more pumps, fluid characteristics, expected water demand, projected water demand. Some embodiments (and related methods) may be used to pump gases (e.g., in chemical processing or manufacturing). Some embodiments may be used to control the energy generated by the flow of fluid (e.g., the flow of fluid through a turbine, the flow of water through a hydro electric generator) in which case the criteria used by block 606 could be criteria that check for an increase in generated energy. Also, some embodiments (and related methods) may be used to maintain a certain energy efficiency level (e.g., a peak level, a high level, a medium level, a low level, a base level). Some methods may perform some of the steps depicted in method 600 in a different order, some methods may combine steps (e.g., block 608 may be combined with block 610) or distribute actions across steps. Some methods may use different variables and some methods may initialize variables to different start values (e.g., variable change_direction may be initialized to "decreasing"). Where some embodiments are used to control a pumping system or are used to control one or more pumps in a pumping system, "increasing the speed of the pumping system" may involve increasing the speed of one or more pumps belonging to the pumping system. Note that in some embodiments increasing the speed of a pump may involve sending a signal to or changing the input to an ASD that controls the speed of a pump motor.

Figure 7:
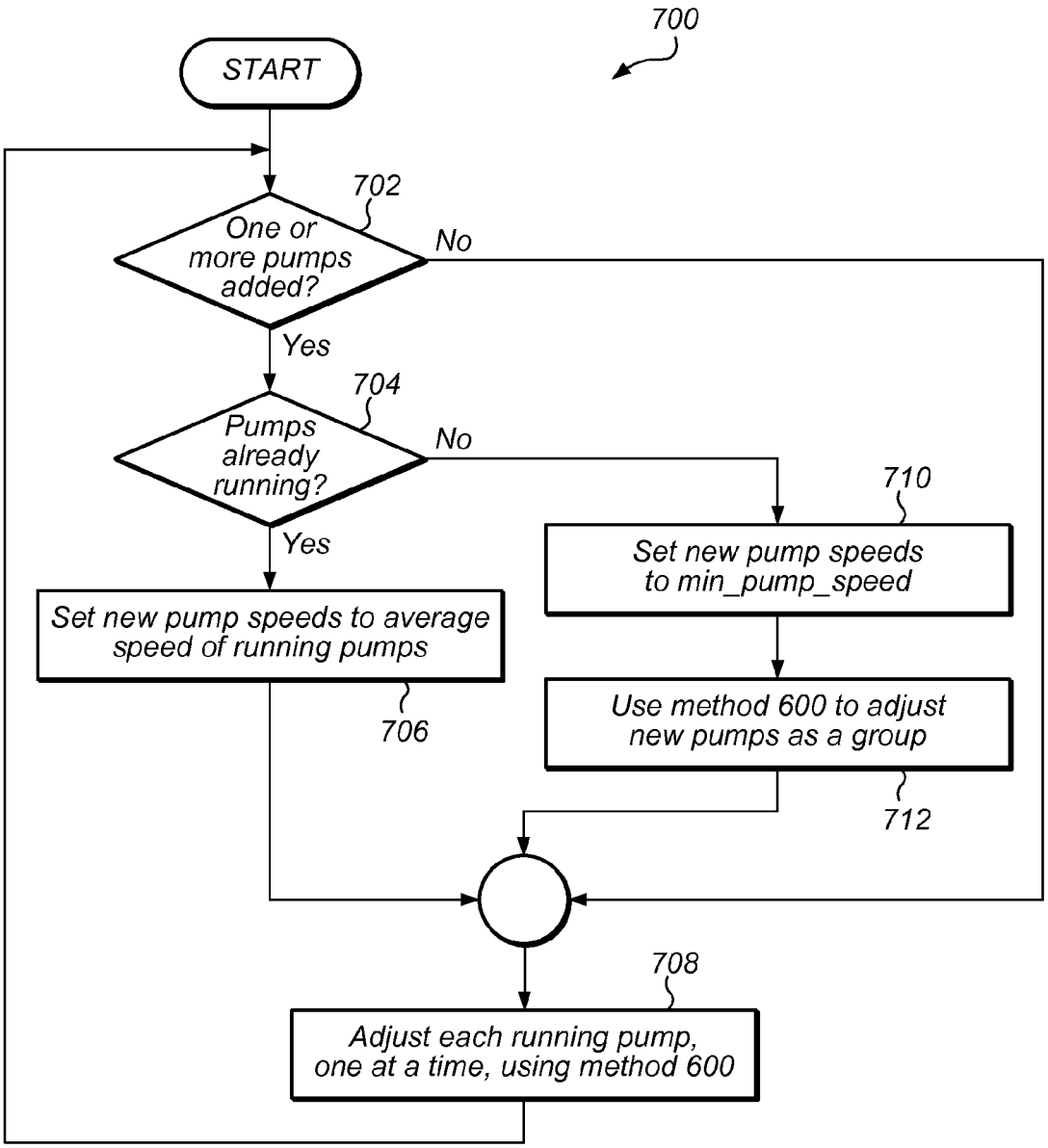
FIG. 7 is a flow chart illustrating the behavior of a plurality of pumps according to an embodiment of the system.

FIG. 7 depicts a flow chart of an exemplary method 700 of controlling one or more pumps (e.g., a pumping system) according to one or more embodiments of the invention. Depicted method 700 includes decision block 702, which may determine if one or more pumps have been added to the pumping system (e.g., one or more additional pumps are to be controlled, one or more pumps in the pumping system have been activated or started). Pumping systems may incorporate mechanisms (e.g., software, control circuitry) for triggering (e.g., activating, bringing on-line) additional pumps and some embodiments may work (e.g., co-operate, communicate) with these mechanisms to control previously activated and newly activated pumps.

In depicted method 700, if it is determined in decision block 702 that one or more pumps have been added, flow proceeds to decision block 704 which may determine if there are pumps currently being controlled (e.g., by method 700, by an embodiment) that are already running (e.g., are energized, are turning, are pumping, have a non-zero speed). If it is determined in block 704 that there are pumps being controlled that are running, flow proceeds to block 706 which may set the speed of the one or more newly added pumps to the average speed of those controlled, already running pumps (e.g., the average speed of previously activated, already running pumps)

If, in the depicted flow 700, it is determined in decision block 704 that there are no running pumps that are currently being controlled (e.g., by method 700), then flow proceeds to block 710 which may set the speed of the non-running newly added pumps to a specific speed (e.g., the minimum pump speed "min_speed" used in method 600).

Flow then proceeds, according to depicted flow 700, from block 710 to block 712 in which method 600 (or another embodiment) may be used to adjust the speed of (e.g., to determine a speed for and to set the speed of) the group of newly added pumps that were set to min_speed in block 710. In block 712, the newly added pumps that were set to min_speed in block 710 may be controlled as a group and may have their speed determined and set as a group (e.g., not individually).

In depicted method 700, flow proceeds from block 706, from block 712 and from the "No" branch of block 702 to block 708. In block 708, each controllable active pump and/or each controllable active group of pumps (e.g., each group of active pumps with shared control) in the pumping system may have its speed adjusted according to an embodiment of method 600. In other words, each controllable active pump may have its speed adjusted according an embodiment (e.g., method 600), where the energy efficiency may be the energy efficiency of the pumping system (e.g., one or more pumps) and the fluid flow rate may be the fluid flow rate of the pumping system.

Following block 708, flow returns to decision block 702, where it may be determined if new pumps have been added. Note that depicted flow 700 may be operated continuously, periodically, a number of times or on-demand according to the embodiment, or constraints of the pumping system.

Advantages

Embodiments of the invention may provide various advantages. By actively adjusting the speed of a pump to optimize energy consumption, energy savings of 15% to 40% may be achieved for typical pumping system installations. An example of a typical water-pumping application may be that of a pump moving water from a ground storage tank through a pipeline to an elevated storage tank. In this application, the cost of moving a given amount of water, (e.g., the daily total customer demand) may be reduced (e.g., minimized) as described herein by controlling the speed of the pump to reduce (e.g., minimize) the amount of energy used to move each gallon of water. The energy used to move a gallon of water is an example of SEC. Due to friction losses in the pipeline, for example, a pump speed that reduces (e.g., minimizes) SEC may be different from a pump speed that increases (e.g., maximizes) the "wire-to-water" efficiency of the pump. Note that "wire-to-water" efficiency may be defined as the ratio of the hydraulic work performed by the pump to the electrical power supplied to the pump motor. Approaches to pump control that seek to operate a pump at its best efficiency point (BEP) may not, in many cases, reduce (e.g., minimize) SEC. As described herein, some embodiments of the present invention may be used to control the speed of a pump to reduce (e.g., minimize) SEC.

Although the embodiments above have been described in considerable detail, numerous variations and modifications will become apparent to those skilled in the art once the above disclosure is fully appreciated. It is intended that the following claims be interpreted to embrace all such variations and modifications.

We claim:

1. A method for improving energy efficiency of a pump system, wherein the pump system comprises one or more pumps, the method comprising:

measuring instantaneous power consumption of the pump system;

measuring instantaneous fluid flow rate of the pump system;

determining an instantaneous specific energy consumption (SEC) of the pump system based on the instantaneous power consumption of the pump system and the instantaneous fluid flow rate of the pump system;

automatically adjusting speed of the one or more pumps according to a change direction in response to said determining, wherein the change direction is increasing or decreasing;

waiting for the pump system to stabilize after said adjusting; and in response to the pump system stabilizing, repeating said measuring instantaneous power consumption, said measuring instantaneous fluid flow rate, said determining, and said adjusting to seek a reduced value of the instantaneous SEC of the pump system;

wherein said determining the instantaneous SEC of the pump system includes:

determining whether the current instantaneous SEC of the pump system is greater than a previous instantaneous SEC of the pump system, and setting the change direction to the opposite direction if the current instantaneous SEC of the pump system is determined to be greater than the previous instantaneous SEC of the pump system.

2. The method of claim 1, wherein the one or more pumps are centrifugal pumps; and wherein said adjusting the speed of the one or more pumps further comprises:

increasing rotational speed of the one or more pumps if the change direction is set to increasing; and decreasing the rotational speed of the one or more pumps if the change direction is set to decreasing.

3. The method of claim 1, wherein said adjusting the speed of the one or more pumps further comprises:

clamping the speed of the one or more pumps to fall between a low speed threshold and a high speed threshold;

adjusting the speed of the one or more pumps by a speed adjustment size;

increasing the speed adjustment size if it is determined that the current instantaneous SEC of the pump system is not greater than a previous instantaneous SEC of the pump system; and decreasing the speed adjustment size if it is determined that the instantaneous SEC of the pump system is greater than the previous instantaneous SEC of the pump system.

4. The method of claim 1, wherein the method is performed without any prior knowledge of: 1) a pump curve associated with the one or more pumps; 2) a pump efficiency curve associated with the one or more pumps; or 3) a system curve associated with the pump system.

5. The method of claim 1, wherein the speed of the one or more pumps is controlled by one or more adjustable speed drives (ASDs);

wherein said adjusting the speed of the one or more pumps comprises adjusting one or more speeds associated with the one or more ASDs.

6. The method of claim 1, wherein the speed of the one or more pumps is controlled by one or more variable transmissions; and wherein said adjusting the speed of the one or more pumps comprises adjusting effective gear ratios associated with the one or more variable transmissions.

7. A computer-readable tangible non-transitory memory medium comprising program instructions for improving energy efficiency of a pump system, wherein the pump system comprises one or more pumps, wherein the program instructions are executable to:

receive a measurement of instantaneous power consumption of the pump system;

receive a measurement of instantaneous fluid flow rate of the pump system;

determine an instantaneous specific energy consumption (SEC) of the pump system based on the measurement of instantaneous power consumption of the pump system and the measurement of instantaneous fluid flow rate of the pump system;

provide an output to adjust speed of the one or more pumps according to a change direction in response to the determination of the instantaneous SEC of the pump system, wherein the change direction is increasing or decreasing;

wait for the pump system to stabilize after said adjusting; and wherein the program instructions are configured to execute a plurality of times, in response to said waiting, to seek a reduced value of the instantaneous SEC of the pump system;

wherein to determine the instantaneous SEC of the pump system, the program instructions are further executable to:

determine whether the current instantaneous SEC of the pump system is greater than a previous instantaneous SEC of the pump system, and set the change direction to the opposite direction if the current instantaneous SEC of the pump system is greater than the previous instantaneous SEC of the pump system.

8. The computer-readable memory medium of claim 7, wherein the one or more pumps are centrifugal pumps; and wherein, to provide the output to adjust the speed of the one or more pumps, the program instructions are further executable to:

provide an output to increase rotational speed of the one or more pumps if the change direction is set to increasing; and provide an output to decrease the rotational speed of the one or more pumps if the change direction is set to decreasing.

9. The computer-readable memory medium of claim 7, wherein, to provide the output to adjust the speed of the one or more pumps, the program instructions are further executable to provide the output to adjust the speed of the one or more pumps so that:

a) the speed of the one or more pumps is clamped between a low speed threshold and a high speed threshold;

b) the size of the speed adjustment is increased relative to the size of a previous speed adjustment if it is determined that the current instantaneous SEC of the pump system is not greater than the previous instantaneous SEC of the pump system; and c) the size of the speed adjustment is decreased relative to the size of the previous speed adjustment if it is determined that the instantaneous SEC of the pump system is greater than the previous instantaneous SEC of the pump system.

10. The computer-readable memory medium of claim 7,
wherein the speed of the one or more pumps is controlled by one or more ASDs;
wherein, to provide the output to adjust the speed of the one or more pumps, the program instructions are further executable to provide one or more outputs to adjust one or more speeds associated with the one or more ASDs.

11. The computer-readable memory medium of claim 7,
wherein the speed of the one or more pumps is controlled by one or more variable transmissions;
wherein, to provide the output to adjust the speed of the one or more pumps, the program instructions are further executable to provide one or more outputs to adjust one or more effective gear ratios associated with the one or more variable transmissions.

12. A pump system comprising:
one or more pumps;
a pump control unit coupled to the one or more pumps;
a power meter coupled to the pump control unit, wherein the power meter is configured to measure instantaneous power consumption of the pump system; and
a flow meter coupled to the pump control unit, wherein the flow meter is configured to measure instantaneous flow rate of the pump system;
wherein the pump control unit is configured to:
obtain from the power meter a measurement of the instantaneous power consumption of the pump system;
obtain from the flow meter a measurement of the instantaneous flow rate of the pump system;
determine an instantaneous specific energy consumption (SEC) of the pump system based on the measurement of the instantaneous power consumption of the pump system and the measurement of the instantaneous flow rate of the pump system;
automatically adjust speed of the one or more pumps according to a change direction in response to the determination of the instantaneous SEC of the pump system, wherein the change direction is increasing or decreasing; and
wait for the pump system to stabilize after said adjusting;
wherein, in response to the pump system stabilizing, the pump control unit is configured to repeat: said obtaining the measurement of the instantaneous power consumption, said obtaining the measurement of the instantaneous flow rate, said determining the instantaneous SEC, and said adjusting the speed of the one or more pumps to seek a reduced value of the instantaneous SEC of the pump system;
wherein, to determine the instantaneous SEC of the pump system, the pump control unit is further configured to:
determine whether the current instantaneous SEC of the pump system is greater than a previous instantaneous SEC of the pump system, and
set the change direction to the opposite direction if the current instantaneous SEC of the pump system is greater than the previous instantaneous SEC of the pump system.

13. The pump system of claim 12,
wherein the one or more pumps are centrifugal pumps; and
wherein, to adjust the speed of the one or more pumps, the pump control unit is further configured to:
increase rotational speed of the one or more pumps if the change direction change is set to increasing; and
decrease the rotational speed of the one or more pumps if the change direction is set to decreasing.

14. The pump system of claim 12,
wherein, to adjust the speed of the one or more pumps, the pump control unit is further configured to:
limit the speed of the one or more pumps to fall between a low speed threshold and a high speed threshold;
increase the size of the speed adjustment relative to a previous size of speed adjustment if it is determined that the instantaneous SEC of the pump system is not greater than a previous instantaneous SEC of the pump system; and
decrease the size of the speed adjustment relative to the previous size of speed adjustment if it is determined that the instantaneous SEC of the pump system is greater than the previous instantaneous SEC of the pump system.

15. The pump system of claim 12,
wherein the speed of the one or more pumps is controlled by one or more ASDs; and
wherein the pump control unit is configured to adjust the speed of the one or more pumps by adjusting one or more speeds associated with the one or more ASDs.

16. The pumping system of claim 12,
wherein the speed of the one or more pumps is controlled by one or more variable transmissions; and
wherein the pump control unit is configured to adjust the speed of the one or more pumps by adjusting effective gear ratios associated with the one or more variable transmissions.

17. A method for improving energy efficiency of a pump system, wherein the pump system comprises a plurality of pumps, the method comprising:
(a) setting a change direction to one of increasing or decreasing;
(b) measuring instantaneous power consumption of the pump system;
(c) measuring instantaneous fluid flow rate of the pump system;
(d) determining a current instantaneous specific energy consumption (SEC) of the pump system based on the instantaneous power consumption of the pump system and the instantaneous fluid flow rate of the pump system;
(e) comparing the current instantaneous SEC of the pump system to a previous instantaneous SEC of the pump system;
(f) setting the change direction to the opposite direction if the current instantaneous SEC of the pump system is greater than the previous instantaneous SEC of the pump system;
(g) adjusting speed of a pump of the plurality of pumps according to the change direction;
(h) repeating steps (b)-(g) a plurality of times; and
(i) repeating steps (a)-(h) for each pump in the plurality of pumps, one pump at a time.

18. The method of claim 17, further comprising repeating steps (a)-(i) a plurality of times.

19. The method of claim 17,
wherein step (i) is repeated until the current instantaneous SEC of the pump system approaches a minimum.

20. The method of claim 17,
wherein said adjusting the speed of the pump in (g) comprises adjusting the speed of the pump according to the change direction and a step size;
wherein step (i) further comprises setting the step size to an initial value; and wherein the method further comprises changing the step size based on the current instantaneous SEC of the pump system and one or more previous values of the instantaneous SEC of the pump system.

21. A computer-readable memory medium comprising program instructions for improving energy efficiency of a pump system, wherein the pump system comprises a plurality of pumps, wherein the program instructions are executable to:

(a) set a change direction to one of increasing or decreasing;

(b) obtain a measurement of instantaneous power consumption of the pump system;

(c) obtain a measurement of instantaneous fluid flow rate of the pump system;

(d) determine a current instantaneous specific energy consumption (SEC) of the pump system based on the instantaneous power consumption of the pump system and the instantaneous fluid flow rate of the pump system;

(e) compare the current instantaneous SEC of the pump system to a previous instantaneous SEC of the pump system;

(f) set the change direction to the opposite direction if the current instantaneous SEC of the pump system is greater than the previous instantaneous SEC of the pump system;

(g) provide an output to adjust speed of a pump of the plurality of pumps according to the change direction;

(h) repeat (b)-(g) a plurality of times; and (i) repeat (a)-(h) for each pump in the plurality of pumps, one pump at a time.

22. The computer-readable memory medium of claim 21, wherein the program instructions are executable to repeat (a)-(i) a plurality of times.

23. The computer-readable memory medium of claim 21, wherein (i) is repeated until the current instantaneous SEC of the pump system approaches a minimum.

24. The computer-readable memory medium of claim 21, wherein in (g) the program instructions are further executable to provide an output to adjust the speed of the pump according to the change direction and a step size;

wherein in (i) the program instructions are further executable to set the step size to an initial value; and wherein the program instructions are further executable to change the step size based on the current instantaneous SEC of the pump system and one or more previous values of the instantaneous SEC of the pump system.

25. A pump system comprising:

one or more pumps;

a pump control unit coupled to the one or more pumps;

a power meter coupled to the pump control unit, wherein the power meter is configured to measure instantaneous power consumption of the pump system;

a flow meter coupled to the pump control unit, wherein the flow meter is configured to measure instantaneous flow rate of the pump system; and wherein the pump control unit is configured to:

(a) set a change direction to one of increasing or decreasing;

(b) receive a measurement of the instantaneous power consumption of the pump system;

(c) receive a measurement of the instantaneous fluid flow rate of the pump system;

(d) determine a current instantaneous specific energy consumption (SEC) of the pump system based on the instantaneous power consumption of the pump system and the instantaneous fluid flow rate of the pump system;

(e) compare the current instantaneous SEC of the pump system to a previous instantaneous SEC of the pump system;

(f) set the change direction to the opposite direction if the current instantaneous SEC of the pump system is greater than a previous instantaneous SEC of the pump system;

(g) provide an output to adjust speed of a pump of the plurality of pumps according to the change direction;

(h) repeat steps (b)-(g) a plurality of times; and (i) repeat steps (a)-(h) for each pump in the plurality of pumps, one pump at a time.

26. The pump system of claim 25, wherein the pump control unit is configured to repeat (a)-(i) a plurality of times.

27. The pump system of claim 25, wherein the pump control unit is configured to repeat (i) until the current instantaneous SEC of the pump system approaches a minimum.

28. The pump system of claim 25, wherein, in (g), the pump control unit is further configured to provide an output to adjust the speed of the pump according to the change direction and a step size;

wherein in (i) the pump control unit is further configured to set the step size to an initial value; and wherein the pump control unit is further configured to change the step size based on the current instantaneous SEC of the pump system and one or more previous values of the instantaneous SEC of the pump system.

* * * * *